US008159341B2

(12) United States Patent
Waugh

(10) Patent No.: US 8,159,341 B2
(45) Date of Patent: Apr. 17, 2012

(54) HAZARD DETECTION AND MITIGATION SYSTEM AND METHOD

(75) Inventor: Michael Jay Waugh, Austin, TX (US)

(73) Assignee: THORAD Corporation, Austin, TX (US)

( * ) Notice: Subject to any disclaimer, the term of this patent is extended or adjusted under 35 U.S.C. 154(b) by 401 days.

(21) Appl. No.: 12/435,965

(22) Filed: May 5, 2009

(65) Prior Publication Data

US 2009/0273479 A1 Nov. 5, 2009

Related U.S. Application Data

(60) Provisional application No. 61/050,256, filed on May 5, 2008.

(51) Int. Cl.
*G08B 1/08* (2006.01)

(52) U.S. Cl. ..... 340/539.27; 340/540; 340/584; 340/539.26; 348/164

(58) Field of Classification Search ..... 340/540, 340/584, 506, 539.26, 539.27, 539.1; 348/164, 348/166

See application file for complete search history.

(56) References Cited

U.S. PATENT DOCUMENTS

| | | | | |
|---|---|---|---|---|
| 5,936,245 | A * | 8/1999 | Goillot et al. | 250/330 |
| 6,529,132 | B2 * | 3/2003 | Boucourt | 340/583 |
| 2006/0187017 | A1 * | 8/2006 | Kulesz et al. | 340/506 |
| 2006/0224797 | A1 * | 10/2006 | Parish et al. | 710/62 |
| 2007/0008099 | A1 * | 1/2007 | Kimmel et al. | 340/506 |
| 2007/0109114 | A1 * | 5/2007 | Farley et al. | 340/506 |
| 2009/0238236 | A1 * | 9/2009 | Fleury-Frenette et al. | 374/121 |

* cited by examiner

*Primary Examiner* — Jennifer Mehmood
*Assistant Examiner* — Hongmin Fan
(74) *Attorney, Agent, or Firm* — Kahler Anderson, PLLC

(57) ABSTRACT

Provided is a system and method for providing monitoring of hazardous materials, including collecting environmental data via one or more sensors directed at the hazardous materials source, the environmental data including one or more environmentally detectable reference points; comparing the environmental data to a set of current ambient conditions, the environmental data detectable in a reference frame by the one or more sensors directed at the hazardous materials source, the reference frame including at least one of the one or more environmentally detectable reference points; performing an alert determination according to the comparison of the environmental data to the set of ambient conditions; and transmitting the alert determination to an existing fault detection system for the hazardous material source to enable the existing fault detection system to override a status rating of the hazardous materials source. Also included is a sensing system including modules operating on a processor to perform the method.

21 Claims, 6 Drawing Sheets

602

604

HAZARD DETECTION AND MITIGATION SYSTEM AND METHOD

CROSS REFERENCE TO RELATED APPLICATIONS

This application claims priority from the U.S. Provisional Patent Application Ser. No. 61/050,256, titled "Hazard Detection and Mitigation System and Method", filed on May 5, 2008, and hereby incorporated by reference.

TECHNICAL FIELD

The present application relates generally to the field of surveillance for use in hazard detection and mitigation and avoidance of hazards.

BACKGROUND

Large petroleum and chemical companies, governments, including the US Department of Homeland Security, foreign governments and other corporations require safety systems to prevent catastrophic events caused by human failure, natural consequences of deteriorating conditions, acts of God, sabotage and the like. Unfortunately, recent failures in current safety solutions have failed to prevent catastrophic events, costing human lives, environmental disasters and billions of dollars in lost productivity. Security and safety hazards to critical infrastructure increasingly cost hundreds of millions to billions of dollars in losses. Historically, separate costly and complicated systems address security threats and safety hazards. The Department of Homeland Security (DHS) Maritime Transportation Security Act (MTSA) and the Chemical Facility Anti-Terrorism Standards (CFATS) currently mandate securing the nation's petrochemical infrastructure against security threats. The disastrous refinery explosion in Texas in 2005 caused by sensor malfunctions highlights the lack of appropriate security and safety systems for monitoring refineries and chemical plants for safety hazards and conditions. Both onshore and offshore critical infrastructure assets are covered by these pieces of legislation.

The term Safety Integrity Level (SIL) is defined as a relative level of risk-reduction provided by a safety function, or to specify a target level of risk reduction. Four SIL levels are defined, with SIL4 being the most dependable and SIL1 being the least. A SIL is determined based on a number of quantitative factors in combination with qualitative factors such as development process and safety life cycle management. One problem with SIL is that the requirements for a given SIL are not consistent among all of the functional safety standards.

The SIL requirements for hardware safety integrity are based on a probabilistic analysis of a situation. Generally, devices in a system should have less than the specified probability of dangerous failure and have greater than the specified safe failure fraction. Generally the statistics are calculated by performing a Failure Modes and Effects Analysis (FMEA). The actual targets required vary depending on the likelihood of a demand, the complexity of the device(s), and types of redundancy used.

PFD (Probability of Failure on Demand) and RRF (Risk Reduction Factor) for different SILs as defined in IEC61508 are exemplary:

TABLE 1

| SIL | PFD | RRF |
|---|---|---|
| 1 | 0.1-0.01 | 10-100 |
| 2 | 0.01-0.001 | 100-1000 |
| 3 | 0.001-0.0001 | 1000-10,000 |
| 4 | 0.0001-0.00001 | 10,000-100,000 |

The SIL requirements for systematic safety integrity define a set of techniques and measures required to prevent systematic failures from being designed into the device or system such as in a refinery or plant or base. These requirements can either be met by establishing a rigorous development process, or by establishing that the device has sufficient operating history to argue that it has been proven in use.

Electric and electronic devices can be certified for use in functional safety applications according to IEC 61508, providing application developers the evidence required to demonstrate that the application including the device is also compliant.

IEC 61511 is an application specific adaptation of IEC 61508 for the Process Industry sector and is used in the petrochemical and hazardous chemical industries, and others.

A problem with the different standards and SIL requirements and an unmet need in the industry is a cost efficient fault detection system appropriate for diverse applications.

SUMMARY

Some embodiments described herein relate to a monitoring system that addresses problems with sensor-based fault detection systems. One embodiment is directed to a method for providing monitoring of hazardous materials, and includes collecting environmental data via one or more sensors directed at the hazardous materials source, the environmental data including one or more environmentally detectable reference points; comparing the environmental data to a set of ambient conditions detectable in a reference frame by the sensor directed at the hazardous materials source, the reference frame including at least one of the one or more environmentally detectable reference points; performing an alert determination according to the comparison of the environmental data to the set of ambient conditions; and transmitting the alert determination to an existing fault detection system for the hazardous material source to enable the existing fault detection system to override a status rating of the hazardous materials source.

In one embodiment, the set of ambient conditions includes one or more of thermal metrics, optical metrics and radioactive metrics appropriate for the one or more environmentally detectable reference points.

In one embodiment, the collecting environmental data via one or more sensors directed at the hazardous materials source, the environmental data including one or more environmentally detectable reference points includes collecting environmental data via the a thermal sensor for sensing temperatures in the hazardous materials source, including one or more of an operating refinery or chemical plant.

In one embodiment, the comparing the environmental data to a set of ambient conditions detectable in a reference frame by the one or more sensors directed at the hazardous materials source, the reference frame including at least one of the one or more environmentally detectable reference points includes processing incoming thermal and optical information from the thermal sensor in real time to detect thermal and/or flow anomalies in the hazardous materials source.

In one embodiment, the collecting environmental data via an image sensor directed at the hazardous materials source, the environmental data including one or more environmentally detectable reference points includes collecting environmental data via the thermal sensor for sensing temperatures in the hazardous materials source, wherein the thermal sensor is configured to collect a frame of video and determine one or more temperatures of the one or more environmentally detectable reference points in a multiple-iteration tour of the hazardous materials source.

In one embodiment, the collecting environmental data via the thermal sensor for sensing temperatures in the hazardous materials source, wherein the thermal sensor is configured to collect a frame of video and determine one or more temperatures of the one or more environmentally detectable reference points in a multiple-iteration tour of the hazardous materials source includes applying a mask to enable the thermal sensor to collect thermal measurements of a predetermined area to enable each frame of video to detect a plurality of locations external to the hazardous materials source. The collecting environmental data via the thermal sensor can include applying a method to select a representative number of pixels of video data for measurement to avoid background temperature interference can include applying a mask to limit the collecting at least nine pixels of video data for measurement to avoid background temperature interference. In one embodiment a representative spot of a minimum of nine pixels is sufficient. Alternatively or additionally, the collecting can include collection a plurality of temperature measurements in a series of video frames in an image tour; and building a model representative of a process associated with the hazardous materials source to enable a process control logic path unique to the hazardous materials source.

In one embodiment, the comparing the environmental data to a set of ambient conditions detectable in a reference frame by the sensor directed at the hazardous materials source, the reference frame includes at least one of the one or more environmentally detectable reference points and includes comparing the environmental data readings via a thermal imaging sensor to the set of ambient conditions by comparing a current thermal determination to a previous thermal determination to establish a ambient "rate-of-rise" or "rate-of-decrease" unique to the hazardous materials source.

In one embodiment, the performing an alert determination according to the comparison of the environmental data to the set of ambient conditions includes providing an alert when rate-of-rise and/or "rate-of-decrease" thermal data determined by the sensor exceeds one or more archived "rate-of-rise" and/or "rate-of-decrease" limits.

In another embodiment, a sensing system is provided, including at least one sensor configured to collect one or more of environmental data including image data, thermal image data and radiation data and/or ambient condition data including wind speed data, precipitation data; a mask filter coupled to the sensor to limit the processing of thermal image data; a processor coupled to the sensor; a memory coupled to the processor; a processing module coupled to the memory, the processing module configured to detect a hazard associated with a hazardous material. The processing module can include a comparator configured to compare received environmentally detectable reference points from the sensor with the current ambient condition data environmental data detectable in a reference frame by the one or more sensors directed at the hazardous materials source, the environmentally detectable reference points located in a reference frame; and an alert determination module configured to perform an alert determination according to the comparator of the environmental data to the set of ambient conditions. The sensing system can further include a transceiver configured to transmit the alert determination to an existing fault detection system for the hazardous material source to enable the existing fault detection system to override a status rating of the hazardous materials source.

In one embodiment, the sensing system is configured to evaluate more than one process at a given location at a facility. This attribute allows for the sensing system to either learn or be programmed to conduct a "tour" of one are of a facility for one process, then conduct a separate "tour" for that corresponding process.

In one embodiment, the sensing system is coupled to an existing fault detection system via a plurality of voting and/or non-voting inputs that can receive the alert determination as a function of importance of the alert.

In another embodiment, the sensing system can be configured to be disposed within one or more of a field programmable gate array (FPGA), an application specific integrated circuit (ASIC), and/or a processor located external to the hazardous materials source.

The foregoing is a summary and thus contains, by necessity, simplifications, generalizations and omissions of detail; consequently, those skilled in the art will appreciate that the summary is illustrative only and is NOT intended to be in any way limiting. Other aspects, features, and advantages of the devices and/or processes and/or other subject described herein will become apparent in the text set forth herein.

BRIEF DESCRIPTION OF THE DRAWINGS

A better understanding of the subject matter of the present application can be obtained when the following detailed description of the disclosed embodiments is considered in conjunction with the following drawings, in which.

DETAILED DESCRIPTION OF THE DRAWINGS

Those with skill in the computing arts will recognize that the disclosed embodiments have relevance to a wide variety of applications and architectures in addition to those described below. In addition, the functionality of the subject matter of the present application can be implemented in software, hardware, or a combination of software and hardware. The hardware portion can be implemented using specialized logic; the software portion can be stored in a memory or recording medium and executed by a suitable instruction execution system such as a microprocessor.

More particularly, the embodiments herein include methods and apparatus/articles of manufacture appropriate for hazard detection and mitigation including embodiments implemented on a computing device and/or other apparatus coupled to an existing safety system for either hardware safety integrity or systematic safety integrity.

Figure 1:
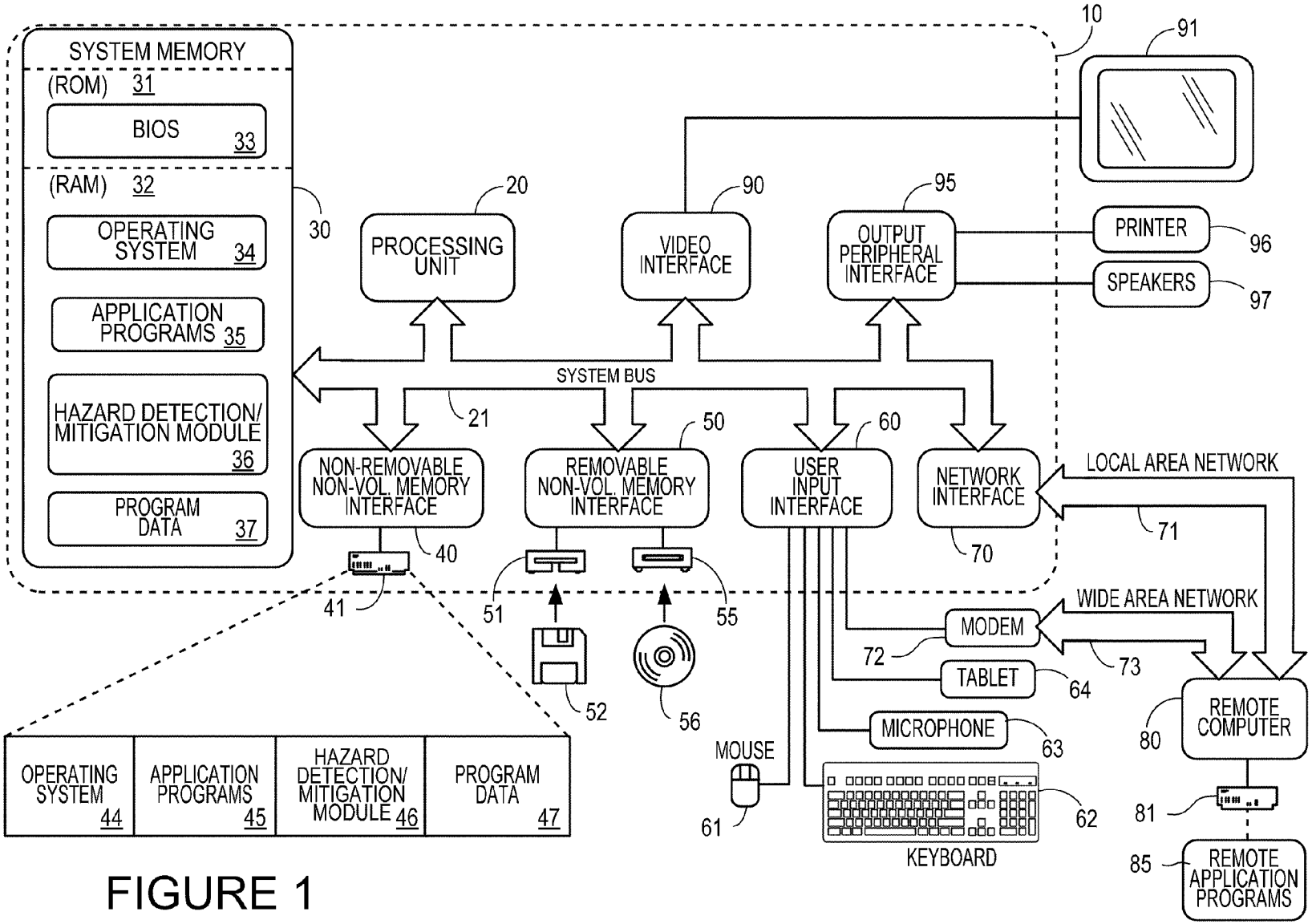
FIG. 1 is a block diagram of an exemplary computer architecture that supports the claimed subject matter.

With reference to FIG. 1, an exemplary computing system for implementing the embodiments and includes a general purpose computing device in the form of a computer 10. Components of the computer 10 may include, but are not limited to, a processing unit 20, a system memory 30, and a system bus 21 that couples various system components including the system memory to the processing unit 20. The system bus 21 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

The computer 10 typically includes a variety of computer readable media. Computer readable media can be any available tangible media that can be accessed by the computer 10 and includes both volatile and nonvolatile media, and removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by the computer 10. Communication media typically embodies computer readable instructions, data structures, program modules or other articles of manufacture capable of storing data. The term "modulated data signal" means a signal that has one or more of its characteristics set or changed in such a manner as to encode information in the signal.

The system memory 30 includes computer storage media in the form of volatile and/or nonvolatile memory such as read only memory (ROM) 31 and random access memory (RAM) 32. A basic input/output system 33 (BIOS), containing the basic routines that help to transfer information between elements within computer 10, such as during start-up, is typically stored in ROM 31. RAM 32 typically contains data and/or program modules that are immediately accessible to and/or presently being operated on by processing unit 20. By way of example, and not limitation, FIG. 1 illustrates operating system 34, application programs 35, other program modules 36 and program data 37. FIG. 1 is shown with program modules 36 including an image processing module in accordance with an embodiment as described herein.

The computer 10 may also include other removable/non-removable, volatile/nonvolatile computer storage media. By way of example only, FIG. 1 illustrates a hard disk drive 41 that reads from or writes to non-removable, nonvolatile magnetic media, a magnetic disk drive 51 that reads from or writes to a removable, nonvolatile magnetic disk 52, and an optical disk drive 55 that reads from or writes to a removable, non-volatile optical disk 56 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and solid state hard disk drives. The hard disk drive 41 can be a solid state hard disk drive and is typically connected to the system bus 21 through a non-removable memory interface such as interface 40, and magnetic disk drive 51 and optical disk drive 55 are typically connected to the system bus 21 by a removable memory interface, such as interface 50. An interface for purposes of this disclosure can mean a location on a device for inserting a drive such as hard disk drive 41 in a secured fashion, or a in a more unsecured fashion, such as interface 50. In either case, an interface includes a location for electronically attaching additional parts to the computer 10.

The drives and their associated computer storage media, discussed above and illustrated in FIG. 1, provide storage of computer readable instructions, data structures, program modules and other data for the computer 10. In FIG. 1, for example, hard disk drive 41 is illustrated as storing operating system 44, application programs 45, other program modules, including image processing module 46 and program data 47. Program modules 46 is shown including an hazard mitigation/detection module, which can be configured as either located in modules 36 or 46, or both locations, as one with skill in the art will appreciate. More specifically, hazard mitigation/detection modules 36 and 46 could be in non-volatile memory in some embodiments wherein hazard mitigation/detection modules runs automatically in an environment, such as in an external environment as described below with reference to FIG. 2. In other embodiments, hazard mitigation/detection modules could part of a control system coupled to an external environment. Note that these components can either be the same as or different from operating system 34, application programs 35, other program modules, including hazard mitigation/detection module 36, and program data 37. Operating system 44, application programs 45, other program modules, including hazard mitigation/detection module 46, and program data 47 are given different numbers hereto illustrate that, at a minimum, they are different copies.

A user may enter commands and information into the computer 10 through input devices such as a tablet, or electronic digitizer, 64, a microphone 63, a keyboard 62 and pointing device 61, commonly referred to as a mouse, trackball or touch pad. Other input devices (not shown) may include a joystick, game pad, satellite dish, scanner, or the like. According to some embodiments, input devices can include sensor devices, including optical and thermal imaging devices 210 and 220 shown in FIG. 2, and could include radar devices, ambient condition detection devices such as anemometers for detecting wind speed, precipitation detectors and the like. These and other input devices are often connected to the processing unit 20 through an input interface 60 that is coupled to the system bus, but may be connected by other interface and bus structures, such as a parallel port, game port or a universal serial bus (USB). A monitor 91 or other type of display device is can also connected to the system bus 21 via an interface, such as a video interface 90. The monitor 91 may also be integrated with a touch-screen panel or the like. Note that the monitor and/or touch screen panel can be physically coupled to a housing in which the computing device 10 is incorporated, such as in a tablet-type personal computer. In addition, computers such as the computing device 10 may also include other peripheral output devices such as speakers 97 and printer 96, which may be connected through an output peripheral interface 95 or the like.

The computer 10 may operate in a networked control center environment using logical connections to one or more remote computers, which could be other wireless devices with a processor or other computers, such as a remote computer 80. The remote computer 80 may be a personal computer, a server, a router, a network PC, PDA, mobile device, a peer device or other common network node, and typically includes many or all of the elements described above relative to the computer 10, although only a memory storage device 81 has been illustrated in FIG. 1. The logical connections depicted in FIG. 1 include a local area network (LAN) 71 and a wide area network (WAN) 73, but may also include other networks. Such networking environments are commonplace in enterprise-wide computer networks appropriate for industrial applications. For example, in the subject matter of the present application, the computer system 10 may comprise the source machine from which data is being migrated, and the remote computer 80 may comprise the destination machine located at a security or safety control center.

When used in a LAN or WLAN networking environment, the computer 10 is connected to the LAN through a network interface or adapter 70. When used in a WAN networking environment, the computer 10 typically includes a modem 72 or other means for establishing communications over the WAN 73. The modem 72, which may be internal or external, may be connected to the system bus 21 via the user input interface 60 or other appropriate mechanism. In a networked environment, program modules depicted relative to the computer 10, or portions thereof, may be stored in the remote memory storage device. By way of example, and not limitation, FIG. 1 illustrates remote application programs 85 as residing on memory device 81. It will be appreciated that the network connections shown are exemplary and other means of establishing a communications link between the computers may be used. In some embodiments, to establish real-time communications, direct wired connections can be used, wireless protocols can be used or the like.

In the description that follows, the subject matter of the application will be described with reference to acts and symbolic representations of operations that are performed by one or more computers, unless indicated otherwise. As such, it will be understood that such acts and operations, which are at times referred to as being computer-executed, include the manipulation by the processing unit of the computer of electrical signals representing data in a structured form. This manipulation transforms the data or maintains it at locations in the memory system of the computer which reconfigures or otherwise alters the operation of the computer in a manner well understood by those skilled in the art. The data structures where data is maintained are physical locations of the memory that have particular properties defined by the format of the data. However, although the subject matter of the application is being described, it is not meant to be limiting as those of skill in the art will appreciate that some of the acts and operation described hereinafter can also be implemented in hardware.

Figure 2:
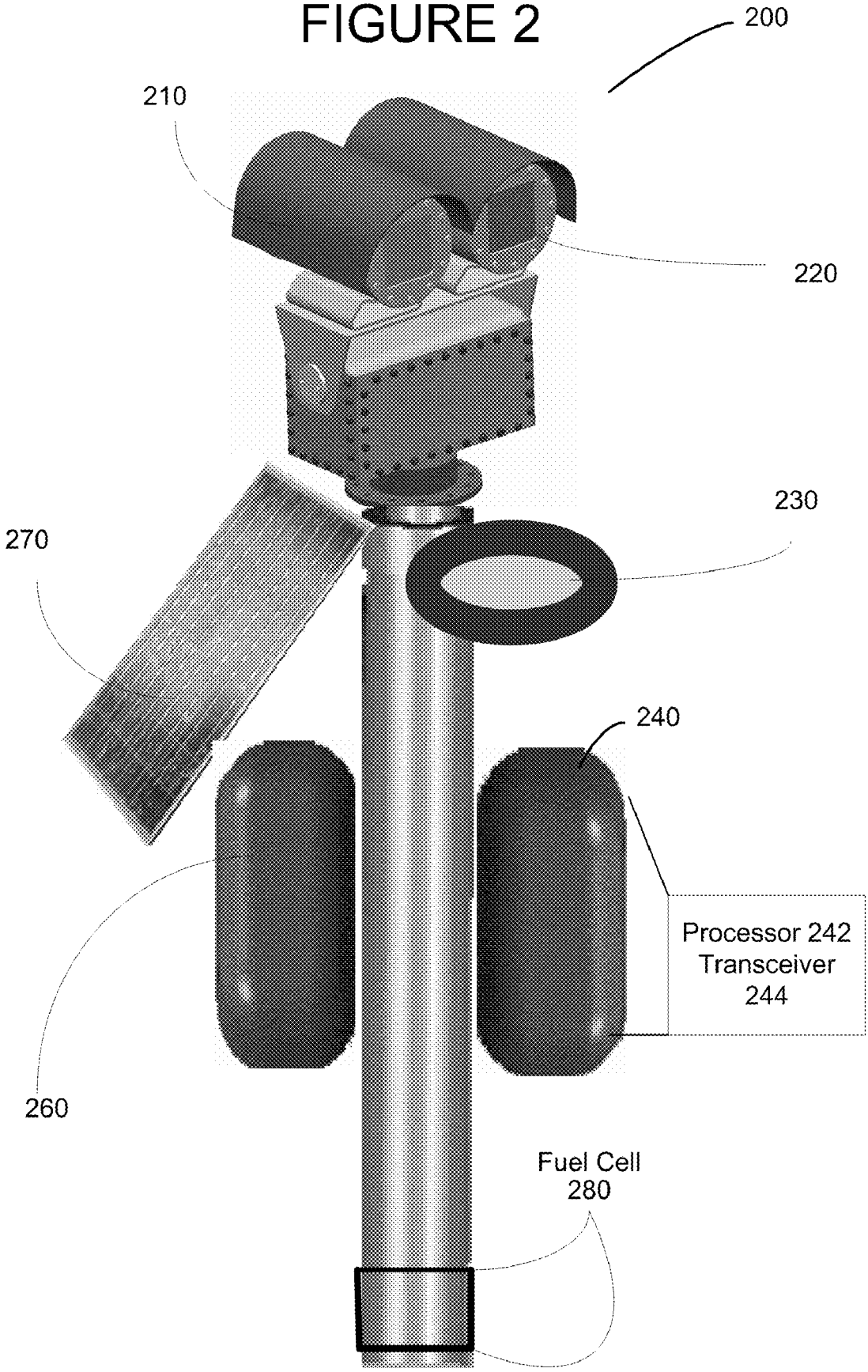
FIG. 2 is an apparatus of an exemplary sensor system in accordance with an embodiment of the present invention.

Referring now to FIG. 2, a sensing system appropriate for embodiments is illustrated. More particularly, FIG. 2 illustrates a sensing system 200 appropriate for large petroleum companies, chemical companies, refineries, petrochemical sites, plants and other hazardous materials sites wherein external piping, process elements such as valves and the like can be externally viewed and sensed.

The CFATS cover security threats to chemical facilities. However, safety and security threats have an overlapping zone where events initiated by a security threat can result in a safety hazard. For example, extortion imposed on an employee or other person with access to a facility by a person or party external to the facility could result in the commission or omission of an act resulting in a hazardous condition. This safety hazard could then cause injury of loss of life and material loss(es).

Sensing system 200 can be configured to be coupled to a network via transceiver 244 and include a processor or microprocessor 242 as shown within housing 240 in accordance with embodiments as illustrated. Sensing system 200 can be implemented as a multi-sensor input device including an optical video camera 210, a thermal sensor 220, which can be implemented as a video sensor, and/or a radar 230. In one embodiment, thermal sensor 220 can be implemented as a radiation detector and/or a forward looking infra red sensor (FLIR). In one embodiment, a radar can be implemented in the system can be a long range radar able to detect objects within ten miles. In another embodiment, the system can include a short range radar able to detect objects within two miles, depending on system requirements.

Sensing system 200 can further include technologies to enable the sensing system to be self-contained, such as a solar power system 270 and appropriate rechargeable or nonrechargeable batteries 260.

Sensing system 200 can also include technologies to enable the sensing system to be self-contained using a fuel cell 280 with or without rechargeable batteries.

Figure 3:
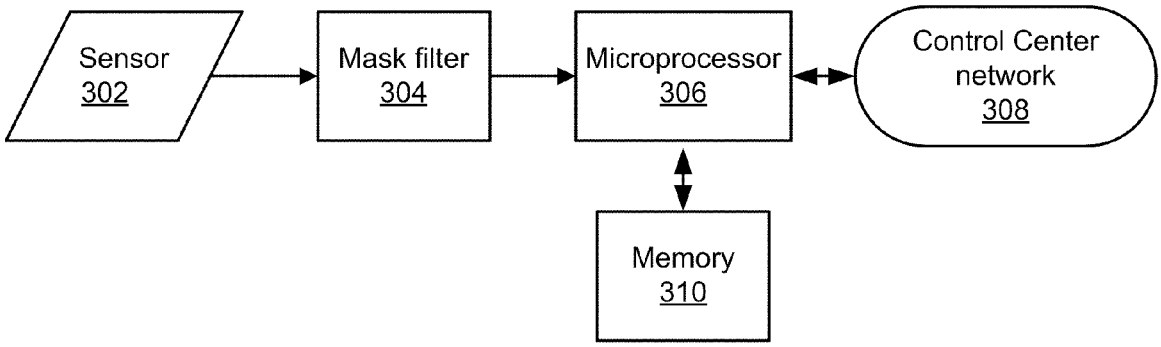
FIG. 3 is a schematic diagram illustrating an embodiment in accordance with an embodiment of the present invention.

Referring now to FIG. 3, one embodiment is directed to a schematic diagram appropriate for operating sensing system 200. As shown, video sensors 302, which could include any of the sensors shown in FIG. 2, such as image video sensor, thermal sensor, radar sensor, FLIR sensor, radiation detector and the like is coupled to a mask filter 304. Mask filter 304 operates to limit the area of video in a frame subject to further analysis. Filtered data from mask filter 304 is received at microprocessor 306 which can be coupled to memory 310. In an embodiment, microprocessor 306 and memory 310 are located within sensing system 200. In other embodiments, sensing system transmits the data to microprocessor 306 via transceiver 244 to a location outside of sensing system 200. Transceiver 244 can be implemented to connect either wirelessly or via a wired connection to a control center network. The data from microprocessor 306/memory 310 is then transmitted to a control center network 308, which can be a computer 10 or other interface so that an existing safety system can be coupled to the data processed by microprocessor 306.

In one embodiment, microprocessor 306 is configured to process a hazard detection mitigation method in a module such as modules 36 and 46 described with reference to FIG. 1.

Figure 4A:
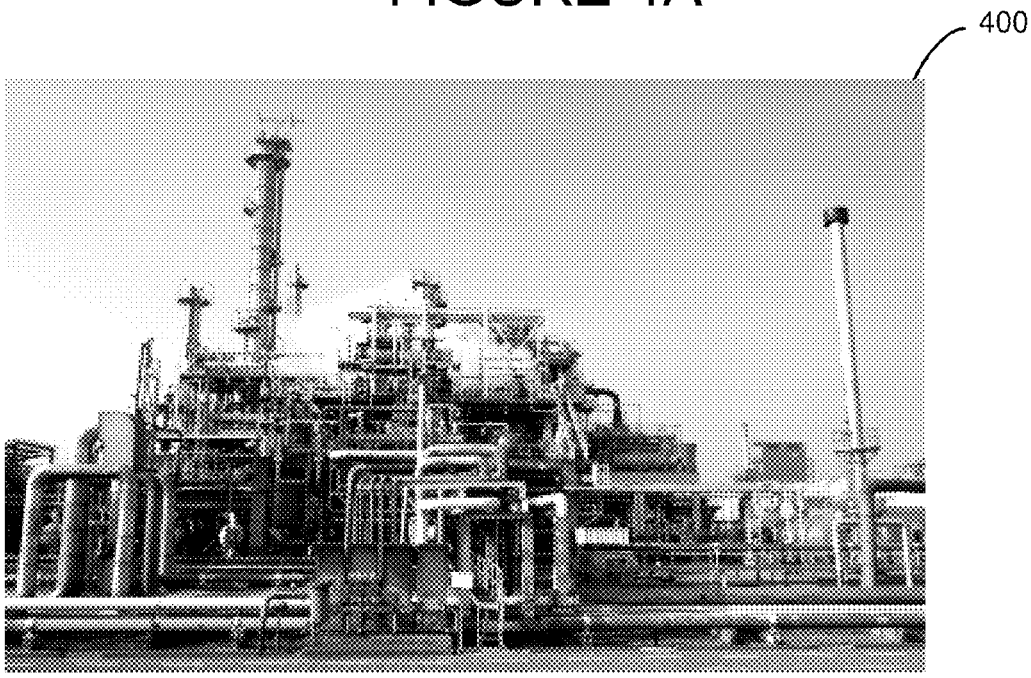
FIG. 4A is a black and white picture of a refinery appropriate for embodiments of the present invention.
Figure 4B:
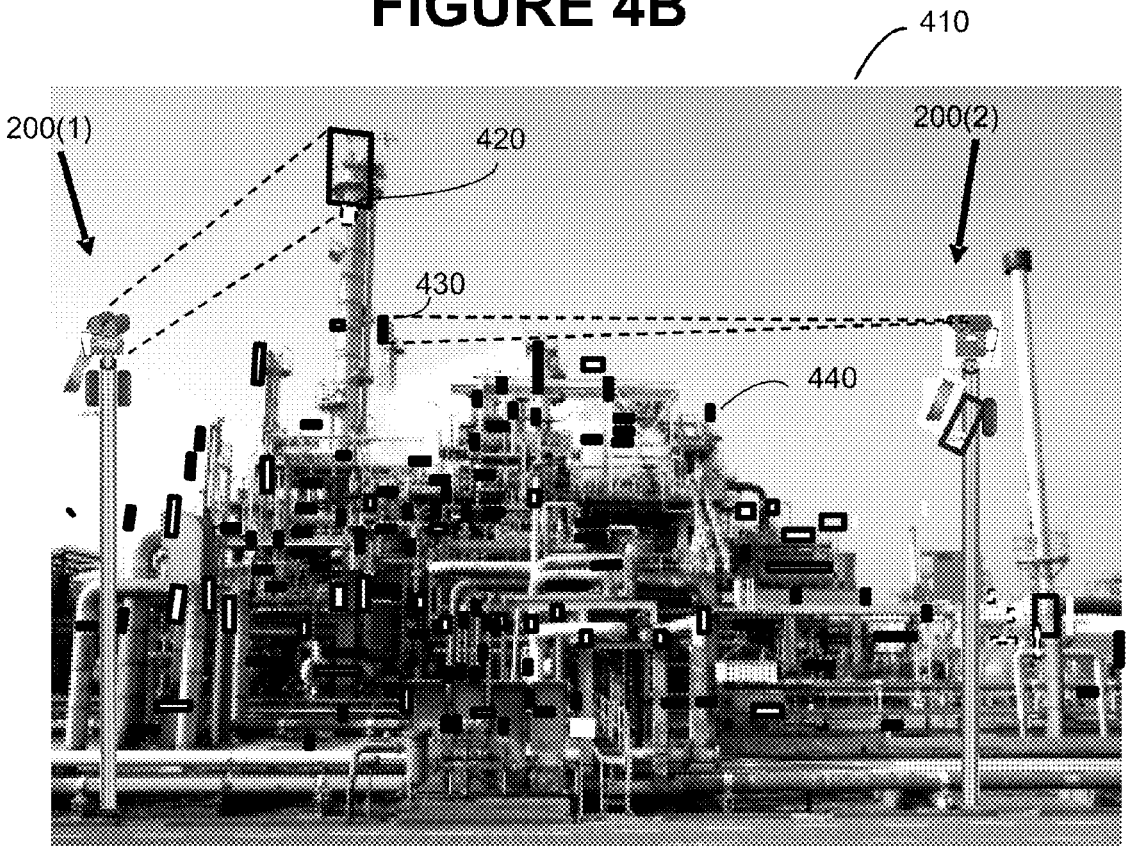
FIG. 4B is a black and white picture of a refinery illustrating implementation of a sensor system in accordance with an embodiment of the present invention.

Referring now to FIGS. 4A and 4B, an exemplary refinery is illustrated with and without a sensing system 200. As shown in FIG. 4A, a refinery includes multiple areas where a petrochemical plant could have various temperature changes due to the operations of plant. Refinery 400 shows a plurality of pipes, each with different purposes.

FIG. 4B illustrates the same refinery with sensing system 200 superimposed on the refinery. As shown, sensing systems 200(1) and 200(2) can be directed to different portions of the refinery and be directed to scan different location points of the refinery such as target 420, 430 and 440.

In accordance with an embodiment, thermal images received by each sensing system 200 and can be processed in a processor 306 in onboard sensing system 200. Hazard mitigation/detection module can then apply the mask filter and examine a sample frame, e.g. 9 pixels, which may be five groups of 9 pixels, and multiple temperature measurements at multiple positions. Each frame of video is taken at each preset position for the corresponding temperature. A masking filter enables a portion of the frame of video for each preset position to be predetermined. For example if the imager is aimed at a piece of 10-inch pipe that sits among other pipes or is in front of a background of another temperature, the mask operates only on a portion of pipe.

The reading is compared with the minimum and maximum allowable temperatures. If the temperature exceeds the threshold temperature, it is reported via radio or fiber optic cable to control center network 308.

In one embodiment, a "tour" of 128 preset stops takes six minutes, so the same location can be measured each six minutes. Each frame of video taken at each "stop" along the "tour" may contain multiple spots to measure for temperature. A minimum of 9 pixels can measure temperature. Multiple 9-pixel spots may be measured per frame. At each "stop" there could be 10 sections of pipe or circuit breakers or other potential hazards that can be accurately measured using (e.g., a FLIR system) a temperature gradient scale that is part of a same video scene. The system looks for rate-of-rise or rate-of-decrease anomalies, threshold anomalies, and logic flow anomalies.

Figure 5:
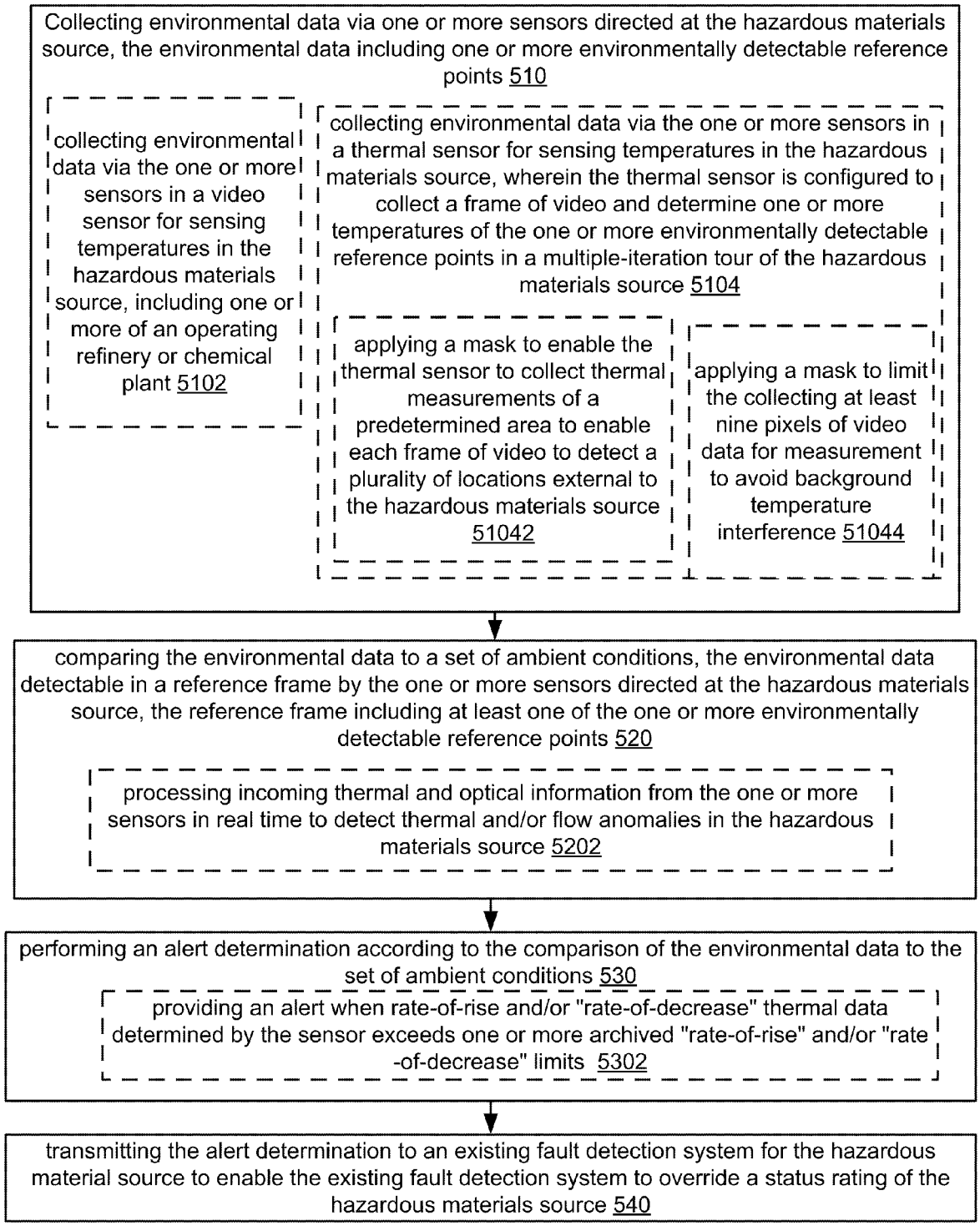
FIG. 5 is a flow diagram illustrating an embodiment in accordance with an embodiments of the present invention.

Referring now to FIG. 5, a flow diagram illustrates a method according to an embodiment for operating the sensing system 200. As discussed below, the sensing system in operation requires a control system to be in place to enable ambient conditions to be input into the system so that each tour of an image sensor does not create false alerts. In operation, FIG. 5 includes block 510 provides for collecting environmental data via one or more sensors directed at the hazardous materials source, the environmental data including one or more environmentally detectable reference points. The detectable reference points can be different locations within a video frame of, for example, points on a raffinate splitter tower or the like. The sensor can include a forward looking infrared sensor, an optical sensor, a radar sensor, or a radiation detector or the like as shown in FIG. 2.

Block 510 includes block 5102 includes collecting environmental data via the one or more sensors in a video sensor for sensing temperatures in the hazardous materials source, including one or more of an operating refinery or chemical plant. The image sensor can be video camera that is wirelessly connected to a network or could also be a wired system in accordance with system requirements. Also within block 510 is optional block 5104 which provides for collecting environmental data via the one or more sensors in a thermal sensor for sensing temperatures in the hazardous materials source, wherein the thermal sensor is configured to collect a frame of video and determine one or more temperatures of the one or more environmentally detectable reference points in a multiple-iteration tour of the hazardous materials source.

Within block 5104 is block 51042 which provides for applying a mask to enable the one or more sensors to collect thermal measurements of a predetermined area to enable each frame of video to detect a plurality of locations external to the hazardous materials source. Also within block 5104 is block 51044 which provides for applying a mask to limit the collecting to at least nine pixels of video data for measurement to avoid background temperature interference.

Block 510 is shown coupled to block 520 which provides for comparing the environmental data to a set of ambient conditions, the environmental data detectable in a reference frame by the one or more sensors directed at the hazardous materials source, the reference frame including at least one of the one or more environmentally detectable reference points.

Disposed within block 520 is optional block 5202 which provides for processing incoming thermal and optical information from the one or more sensors in real time to detect thermal and/or flow anomalies in the hazardous materials source.

In one embodiment, the comparisons include comparing against acceptable maximum and minimum temperatures for each reference point to determine whether an alert should be made. In another embodiment, the comparisons include comparing each reference point or "spot" in a last from of video or "tour" for rate of rise information. In another embodiment, sensors can be configured to determine of a gas leak has occurred by locating thermal anomalies and/or frequency alterations in a sensor surrounding a pipe or valve or the like. In another embodiment, radiation can be detected via a sensor configured for appropriate radioactive materials. In any event, once a frame is determined and analyzed.

Block 520 is shown coupled to block 530 which provides for performing an alert determination according to the comparison of the environmental data to the set of ambient conditions. Disposed within block 530 is block 5302 which provides for providing an alert when rate-of-rise and/or "rate-of-decrease" thermal data determined by the sensor exceeds one or more archived "rate-of-rise" and/or "rate-of-decrease" limits. More particularly, each frame of video taken by the one or more sensors at each "stop" along a "tour" may contain multiple reference points to measure for temperature. A minimum of 9 pixels are required to measure temperature in one embodiment. Multiple 9-pixel points as shown in FIG. 2 may be measured per frame. At each "stop" there could be 10 sections of pipe or circuit breakers or other potential hazards that can be accurately measured using the FLIR temperature gradient scale that is part of the video scene. The system looks for rate of rise anomalies, threshold anomalies, and logic flow anomalies Block 530 is shown coupled to block 540 which provides for transmitting the alert determination to an existing fault detection system for the hazardous material source to enable the existing fault detection system to override a status rating of the hazardous materials source. For example, if ambient conditions indicate that a tower is overheating, regardless of what existing safety metrics indicate, the sensing system 200 can override a status.

As described above, FIG. 5 illustrates a flow diagram of a sensing system 200 in operation. As one of ordinary skill in the art with the benefit of the present disclosure will appreciate however, ambient conditions for hazardous materials sites will change as dependent on time of day, wind conditions, calendar date, weather conditions, precipitation conditions and the like. Accordingly, ambient conditions can be characterized by those predetermined via readily available data, such as time of day, and known processes being performed at a hazardous materials location and those that must be determined in real time, such as precipitation level and wind speed. According to an embodiment, ambient conditions affect the determination of whether an alert is necessary. In accordance with an embodiment, ambient conditions can be determined by performing noise analysis to determine an average noise amplitude and noise distribution for each image plane via a radient calculation. Part of determining if an alert is necessary is determining correct ambient conditions for the data collected by any sensor For example, the system measures temperatures in frame one, then frame two, etc., of the "imager tour" and builds a model of what the process is during that particular tour. If pipe 1 in frame 1 measures 220° C., then pipe 1 in frame 2 from a different pass must be the same or similar temperature taking into account ambient conditions and any current running process programmed into the system, or an anomaly alert will be generated. When the subsequent measurement in a process is not in accordance with the process, taking into consideration the ambient conditions detected in a prior frame or pass, the alert can be a function of the differential between normal operating conditions and the detected alteration. Advantageously, any detected changes can be provided to an existing fault detection system as either non-voting or voting inputs. In one embodiment, non-voting inputs include alert notifications that do not warrant immediate action. Non-voting inputs to an existing fault detection system are known and can include displayed results, optical images and corresponding fault detection pints in process. In another embodiment, voting inputs can be provided to an existing fault detection system, such as a SIEMENS system to allow for a shut down/override/fail-safe of a hazardous situation. For example, voting inputs can be provided to either alert an operator, or to shut down a process as a function of programming or process control or system requirements.

In one embodiment, sensing system 200 can include a cascade of alarm conditions and/or visual output to control center network 308. Outputs can include video images and temperatures, radiation detection, gas leak detection and other data determined by sensing system 200.

Referring back to FIG. 3, sensor 302 can be operated by either a control room operator(s) or an automated program to set up each preset "stop" in a 128-stop or appropriate "tour" and to assign the maximum and minimum allowable temperature thresholds. Each frame of video can provide multiple objects to measure.

In accordance with one embodiment, laser radar and/or robotics can be used to determine appropriate positions for the one or more sensors in sensing system 200. For example, a best position to view or pick up temperatures in a refinery can be subject to change or be hidden by other processes. A mobile form could enable ambient frames followed by environmental data frames efficiently. Also, a laser radar can be used to determine which towers are more critical to a hazard. The laser radar can also be used to "map" an area of a chemical plant or refinery from a roadway surrounding the facility. A map can be used by the robotic mounted sensor or sensors to observe elements of the facility from different angles. The same procedure of taking an ambient frame of video and comparing it to the spots in each "stop" along a "tour" could be used to provide additional information used to determine if a safety and/or security threat exists.

In one embodiment, artificial intelligence in combination with a global positioning system can more accurately identify critical towers and other local objects subject to hazardous conditions.

In another embodiment, direction microphones or omnidirectional microphone so that sounds of humans following a disaster or for other purposes can be detected. Sounds and/or heat detected by a microphone/thermal sensor/of personnel under duress during a crisis such as an explosion or fire can be detected and listen in on conversations held by employees in sensitive installations where a possibility of a threat can be vocalized. Referring back to FIG. 2, item 230 can be configured with a microphone.

In another embodiment, artificial intelligence can be used, such as a computer vision system or other processing system to determine a best place exterior to a hazardous material source to place one or more sensors or provide mobile tours of potential hazards via a mobile LIDAR (laser radar).

Figure 6:
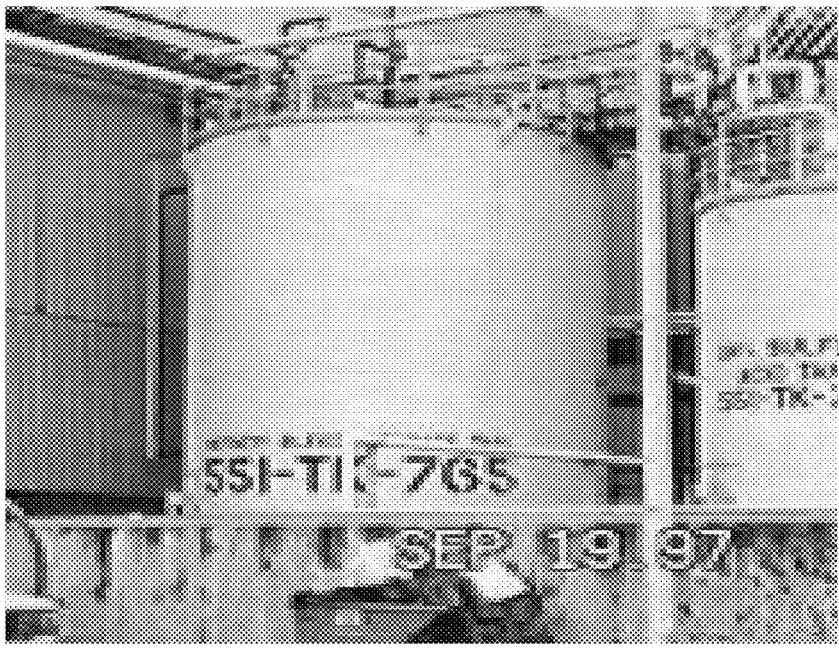
FIG. 6 illustrates black and white pictures of a refinery tank including a normal image and a thermal image.
Figure 6:
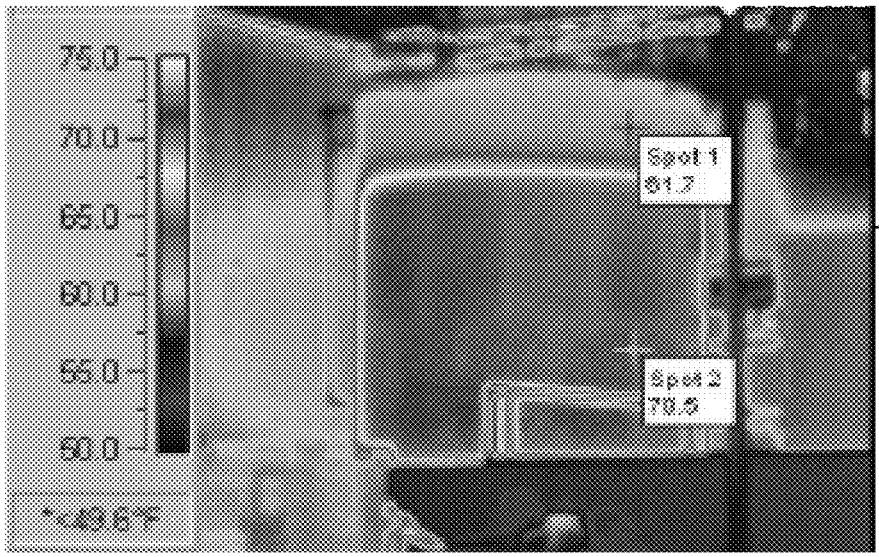

Referring to FIG. 6, black and white photos 602 and 604 illustrate the difference between an image 602 and a thermal image 604. As can be seen in these photos, information pertaining to material inside a tank, pipe or other vessel can be detected on the surface of these containers. Embodiments herein not only are directed to thermal imaging outside of containers but from up to ten miles away.

While the subject matter of the application has been shown and described with reference to particular embodiments thereof, it will be understood by those skilled in the art that the foregoing and other changes in form and detail may be made therein without departing from the spirit and scope of the subject matter of the application, including, but not limited to additional, less or modified elements and/or additional, less or modified steps performed in the same or a different order.

Those having skill in the art will recognize that the state of the art has progressed to the point where there is little distinction left between hardware and software implementations of aspects of systems; the use of hardware or software is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically-oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in standard integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies equally regardless of the particular type of signal bearing media used to actually carry out the distribution. Examples of a signal bearing media include, but are not limited to, the following: recordable type media such as floppy disks, hard disk drives, CD ROMs, digital tape, and computer memory.

The herein described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.).

I claim:

1. A method for providing monitoring of hazardous materials, the method comprising:

collecting environmental data via one or more sensors directed at the hazardous materials source, the environmental data including one or more environmentally detectable reference points including:

collecting environmental data via the one or more sensors in a thermal sensor for sensing temperatures in the hazardous materials source, wherein the thermal sensor is configured to collect a frame of video and determine one or more temperatures of the one or more environmentally detectable reference points in a multiple-iteration tour of the hazardous materials source; and applying a mask to enable the thermal sensor to collect thermal measurements of a predetermined area to enable each frame of video to detect a plurality of locations external to the hazardous materials source; and comparing the environmental data to a set of current ambient conditions, the environmental data detectable in a reference frame by the one or more sensors directed at the hazardous materials source, the reference frame including at least one of the one or more environmentally detectable reference points;

performing an alert determination according to the comparison of the environmental data to the set of ambient conditions; and transmitting the alert determination to an existing fault detection system for the hazardous material source to enable the existing fault detection system to override a status rating of the hazardous materials source.

2. The method of claim 1 wherein the set of environmental data includes:

one or more of thermal metrics, optical metrics and radioactive metrics appropriate for the one or more environmentally detectable reference points.

3. The method of claim 1 wherein collecting environmental data via an image sensor directed at the hazardous materials source, the environmental data including one or more environmentally detectable reference points includes:

collecting environmental data via the one or more sensors for sensing temperatures in the hazardous materials source, including one or more of an operating refinery or chemical plant.

4. The method of claim 1 wherein the comparing the environmental data to a set of current ambient conditions, the environmental data detectable in a reference frame by the one or more sensors directed at the hazardous materials source, the reference frame including at least one of the one or more environmentally detectable reference points includes:

processing incoming thermal and optical information from the one or more sensors in real time to detect thermal and/or flow anomalies in the hazardous materials source.

5. The method of claim 1 wherein the collecting environmental data via the one or more sensors in a thermal sensor for sensing temperatures in the hazardous materials source, wherein the thermal sensor is configured to collect a frame of video and determine one or more temperatures of the one or more environmentally detectable reference points in a multiple-iteration tour of the hazardous materials source includes:

applying a mask to limit the collecting of video data for measurement to avoid background and noise temperature interference.

6. The method of claim 5 wherein the applying a mask to limit the collecting of video data for measurement to avoid background and noise temperature interference includes:

selecting one or more of a most stable set of nine pixels of video data for measurement.

7. The method of claim 1 wherein collecting environmental data via one or more sensors directed at the hazardous materials source, the environmental data including one or more environmentally detectable reference points includes:

collecting a plurality of temperature measurements in a series of video frames in an image tour; and building a model representative of a process associated with the hazardous materials source to enable a process control logic path unique to the hazardous materials source.

8. The method of claim 1 wherein the comparing the environmental data to a set of ambient conditions detectable in a reference frame by the one or more sensors directed at the hazardous materials source, the reference frame including at least one of the one or more environmentally detectable reference points includes:

comparing the environmental data readings via a thermal imaging sensor to the set of ambient conditions by comparing a current thermal determination to a previous thermal determination to establish a ambient "rate-of-rise" or "rate-of-decrease" unique to the hazardous materials source.

9. The method of claim 1 wherein the performing an alert determination according to the comparison of the environmental data to the set of ambient conditions includes:

providing an alert when rate-of-rise and/or "rate-of-decrease" thermal data determined by the sensor exceeds one or more archived "rate-of-rise"and/or "rate -of-decrease" limits.

10. The method of claim 1 further comprising:

providing one or more alerts to the existing fault detection system as one of voting or non-voting inputs to the existing fault detection system, wherein the voting inputs enable an override of the existing fault detection system.

11. The method of claim 1 further comprising:

providing a hierarchical alarm condition alert to the existing fault detection system to enable an operator to determine a hazard status.

12. The method of claim 1 further comprising:

providing a hierarchical alarm condition alert when the existing fault detection system enables voting inputs and non-voting inputs of the existing fault detection system to be activated as a function of a hazard status.

13. The method of claim 1 further comprising:

providing one or more alarm outputs to an external network to enable a determination by governmental authorities of an impending hazardous situation.

14. The method of claim 1 wherein the environmental data is n-dimensional data to enable a plurality of metric calculations to be performed thereon including real-time determinations of ambient conditions to avoid false alarm conditions.

15. The method of claim 1 wherein the data is image data collected from one or more of a Bayer pattern sensor array, CMOS sensor array and a thermal image data array.

16. The method of claim 1 wherein the hazardous material source includes one or more of a radioactive plant, an oil refinery, a chemical plant, a natural gas plant, a fuel mine, a coal mine, a uranium mine, an ordinance explosive device, a potentially hazardous process and/or an artillery source.

17. The method of claim 1 wherein the method is performed in one or more of a field programmable gate array (FPGA), an application specific integrated circuit (ASIC), and/or a processor.

18. A computer program product comprising a computer readable medium configured to perform one or more acts for monitoring a hazardous material source the one or more acts comprising:

one or more instructions for collecting environmental data via one or more sensors directed at the hazardous materials source, the environmental data including one or more environmentally detectable reference points, including:

one or more instructions for collecting environmental data via the one or more sensors in a thermal sensor for sensing temperatures in the hazardous materials source, wherein the thermal sensor is configured to collect a frame of video and determine one or more temperatures of the one or more environmentally detectable reference points in a multiple-iteration tour of the hazardous materials source; and one or more instructions for applying a mask to enable the thermal sensor to collect thermal measurements of a predetermined area to enable each frame of video to detect a plurality of locations external to the hazardous materials source; and one or more instructions for performing noise analysis to determine an average noise amplitude and noise distribution for each image plane via a gradient calculation;

one or more instructions for comparing the environmental data to a set of current ambient conditions, the environmental data detectable in a reference frame by the one or more sensors directed at the hazardous materials source, the reference frame including at least one of the one or more environmentally detectable reference points;

one or more instructions for performing an alert determination according to the comparison of the environmental data to the set of ambient conditions; and one or more instructions for transmitting the alert determination to an existing fault detection system for the hazardous material source to enable the existing fault detection system to override a status rating of the hazardous materials source.

19. A sensing system comprising:

one or more sensors configured to collect one or more of environmental data including image data, thermal image data and radiation data and/or ambient condition data including wind speed data, precipitation data , the one or more sensors configured to sense temperatures in a hazardous materials source, wherein a thermal sensor of the one or more sensors is configured to collect a frame of video and determine one or more temperatures of one or more environmentally detectable reference points in a multiple-iteration tour of the hazardous materials source; and one or more instructions for applying a mask to;

a mask filter coupled to the one or more sensors to limit the processing of thermal image data and enable the thermal sensor to collect thermal measurements of a predetermined area to enable each frame of video to detect a plurality of locations external to the hazardous materials source;

a processor coupled to the sensor;

a memory coupled to the processor;

a processing module coupled to the memory, the processing module configured to detect a hazard associated with a hazardous material, module including:

a comparator configured to compare received environmentally detectable reference points from the one or more sensors with the current ambient condition data environmental data detectable in a reference frame by the one or more sensors directed at the hazardous materials source, the environmentally detectable reference points located in a reference frame; and an alert determination module configured to perform an alert determination according to the comparator of the environmental data to the set of ambient conditions; and a transceiver configured to transmit the alert determination to an existing fault detection system for the hazardous material source to enable the existing fault detection system to override a status rating of the hazardous materials source.

20. The sensing system of claim 19 wherein the existing fault detection system includes a plurality of voting and/or non-voting inputs that can receive the alert determination as a function of importance of the alert.

21. The sensing system of claim 19 wherein the sensing system is disposed within one or more of a field programmable gate array (FPGA), an application specific integrated circuit (ASIC), and/or a processor located external to the hazardous materials source.

* * * * *